US005776597A

United States Patent [19]

Watanabe et al.

[11] Patent Number: 5,776,597

[45] Date of Patent: Jul. 7, 1998

[54] SPEAKER DAMPER

[75] Inventors: Hirosuke Watanabe, Ibaraki; Takeo Kimura, Osaka; Masatoshi Okazaki, Ashiya; Shinya Mizone, Tsu, all of Japan

[73] Assignees: Teijin Limited; Matsushita Electric Industrial Co., Ltd., both of Osaka, Japan

[21] Appl. No.: 603,867

[22] Filed: Feb. 22, 1996

[51] Int. Cl.[6] ..... H04R 7/26; H04R 31/00

[52] U.S. Cl. ..... 428/297.4; 442/60; 442/85; 442/104; 442/189; 442/197; 442/199; 442/301

[58] Field of Search ..... 442/60, 85, 104, 442/189, 197, 199, 301; 428/297.4

[56] References Cited

U.S. PATENT DOCUMENTS

| | | | |
|---|---|---|---|
| 4,029,835 | 6/1977 | Iwata et al. | 428/212 |
| 4,741,873 | 5/1988 | Fischer et al. . | |
| 5,177,840 | 1/1993 | Laws | 28/220 |
| 5,549,965 | 8/1996 | Heinrich et al. | 428/229 |

FOREIGN PATENT DOCUMENTS

| | | |
|---|---|---|
| 0182335 | 5/1986 | European Pat. Off. . |
| 0303173 | 2/1989 | European Pat. Off. . |
| 0675668 | 10/1995 | European Pat. Off. . |
| 59-10639 | 3/1984 | Japan . |
| 62-258596 | 11/1987 | Japan . |
| 5183991 | 7/1993 | Japan . |
| 1361242 | 7/1974 | United Kingdom . |

*Primary Examiner*—Kathleen Choi
*Attorney, Agent, or Firm*—Sherman and Shalloway

[57] ABSTRACT

There is provided a speaker damper for use in an acoustic output device, which exhibits excellent shape retaining property at the time of molding, is highly safe to work environment and has excellent water resistance, heat resistance an durability. The speaker damper is obtained by impregnating cloth formed of mixed yarn of a wholly aromatic polyamide fiber and an aromatic polyester fiber with a polyester resin, and molding the cloth under heat and pressure.

7 Claims, 2 Drawing Sheets

SPEAKER DAMPER

DETAILED DESCRIPTION OF THE INVENTION

1. Field of the Invention

This invention relates to a speaker damper which is incorporated in a speaker of a sound output device or the like, and to a production method thereof. More specifically, it relates to a speaker damper which is excellent in water resistance and dimensional stability, maintains the performance of a speaker for a prolonged time and improves workability of production thereof, and to a production method thereof.

2. Prior Art

A speaker damper is one of the parts of a speaker of a sound output device, is bonded to a speaker frame and a coil bobbin for transmitting vibration to a speaker corn which generates sound in a radial manner, has a function to support these parts elastically and has the shape that concentric corrugations spreads in a plate-like form.

This speaker damper needs to have the following basic features: (1) it has excellent stability for holding the coil bobbin and (2) it reciprocates the speaker corn precisely according to stress generated in the coil bobbin, that is, it is excellent in hysteresis.

Heretofore, various structural materials for a speaker damper have been proposed. They include, for example, one prepared by impregnating cloth formed of a phenol fiber with a phenol resin (JP-A-53-48520 (the term "JP-A" as used herein means an "unexamined published Japanese patent application"), one prepared by impregnating cloth formed of a wholly aromatic polyamide fiber and cotton with a phenol resin (JP-A-62-258596), and one prepared by impregnating cloth formed of mixed yarn of para type aromatic polyamide fibers and meta type aromatic polyamide fibers with a curable resin such as a phenol resin (JP-A-5-183991). In all of the above prior arts, a prepreg prepared by impregnating a woven cloth with a thermosetting resin is used as a substrate which is cured and simultaneously molded into a desired shape in a heated mold to produce a speaker damper.

Although the substrate used in the above methods requires a step of preparing a prepreg impregnated with a thermosetting resin as a shape retaining agent, it has been noted that a solution of a resin such as a phenol resin or a melamine resin which is used as a shape retaining agent not only in this step but also the molding step involves such problems in work environment as attack of a rash on the skin and generation of a toxic gas at the time of drying and/or curing.

As for the molding of the above substrate, the shape retaining agent is a thermosetting resin, and is cured by a heat reaction in a mold heated at a predetermined temperature to mold the substrate into a predetermined shape. Since the cloth which is a matrix of the substrate is, as described above, formed of a natural fiber cotton fabric, heat resistant aramide fibers or phenol fibers, it hardly transforms in the heated mold and its shape is retained mainly by the shape retaining agent.

However, as one of molding conditions, the mold temperature is generally set to a high temperature of 180° C. or higher. Because of this, the shape retaining agent has the following problems with moldability: (1) it remains relatively soft rubber in the mold even after completion of a curing reaction, and (2) it is deformed by internal stress of the matrix cloth having relatively high rigidity and cannot retain its predetermined shape when it is taken out of the mold after molding.

Further, the resin of the shape retaining agent retains an extremely high rigidity after cooling to normal temperature. However, since a phenol resin, a melamine resin or the like used as the shape retaining agent has low affinity for the fibers constituting the matrix cloth, the speaker damper has the following problems with durability as a speaker member: (1) peeling occurs in the interface between the matrix cloth and the shape retaining agent when a molded product as a speaker damper material is subjected to repetitions of deformation such as deflection or bending, (2) the shape retaining agent covering the surface of the matrix cloth in a thin film form cracks because it cannot follow the deflection of the cloth having flexibility, and (3) as the result, the fixing portions of the intersections of yarns constituting the cloth are ruptured, resulting in a remarkable reduction in the rigidity of the damper.

Moreover, for applications which require water resistance, such as a speaker which is installed in the door of a car, a damper needs to be water resistant in particular, because it is easily affected by water such as rain coming from the window or water leakage during car washing, and also needs to be little deformed by repetitions of wetting and drying. The above substrate of a damper, however, has the following problem with water resistance. Since the resin of the shape retaining agent has a relatively high coefficient of water absorption, the shape retaining agent itself deforms when it absorbs water and the shape retaining agent covering the surfaces of the fibers of the cloth cracks. Water coming from the cracks fill the gap between the fibers of the matrix cloth and is absorbed by the fibers, whereby the cloth deforms by stretch. As the result, the damper as a molded product deforms, and affects the performance of a speaker.

DISCLOSURE OF THE INVENTION

A first object of the invention is to provide a speaker damper which experiences little deterioration in performance when it is used as a speaker member and has excellent water resistance, moisture resistance and heat resistance.

A second object of the invention is to provide a speaker damper which experiences little deterioration in shape retaining property and the characteristics of a speaker when it is used as a speaker member for a prolonged period.

A third object of the invention is to provide a method for producing a speaker damper which has no bad influence upon work environment, that is, which is safe in impregnation and molding steps and generates no toxic gas.

According to studies conducted by the inventors of the present invention, the above objects of the present invention can be accomplished by a speaker damper which is composed of cloth, as a matrix component, formed of a wholly aromatic polyamide yarn, wherein (i) the wholly aromatic polyamide yarn is mixed yarn containg a thermoplastic aromatic polyester fiber having a thermal fusing temperature which is at least 100° C. lower than the thermal decomposition temperature of a wholly aromatic polyamide fiber constituting said mixed yarn, (ii) the wholly aromatic polyamide fibers constituting the mixed yarn are fixed together by the fusion of the thermoplastic aromatic polyester fiber, (iii) the constituent fibers forming the yarn are fixed together with a shape retaining agent containing a polyester resin in the mixed yarn, and (iv) the mixed yarns are fixed together with the shape retaining agent containing a polyester resin and by the fusion of the thermoplastic aromatic polyester fiber at intersections thereof in the cloth.

According to studies conducted by the inventors, another object of the present invention can be accomplished by a method for producing a speaker damper which is composed of cloth, as a matrix component, formed of a wholly aromatic polyamide yarn, the method comprising the steps of:

impregnating the cloth formed of mixed yarn of a wholly aromatic polyamide fiber and an aromatic polyester fiber with an aqueous solution of a water-soluble polyester resin, drying the cloth, and then molding the cloth into a desired shape under temperature and pressure conditions which are sufficient for the wholly aromatic polyamide fibers to be fixed together by the fusion of the aromatic polyester fiber and for the mixed yarns to be fixed together by the polyester resin in the mold.

BRIEF DESCRIPTION OF THE DRAWINGS

FIG. 1(*b*) is an enlarged view of the surface condition of a speaker damper after molding.

BEST MODE FOR CARRYING OUT THE INVENTION

Figure 1:
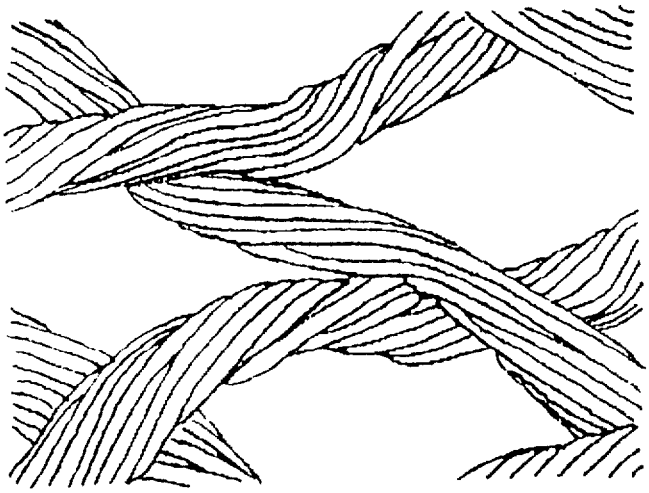
FIG. 1(*a*) is an enlarged view of the surface condition of the cloth of the present invention before it is impregnated with a polyester resin.
Figure 1:
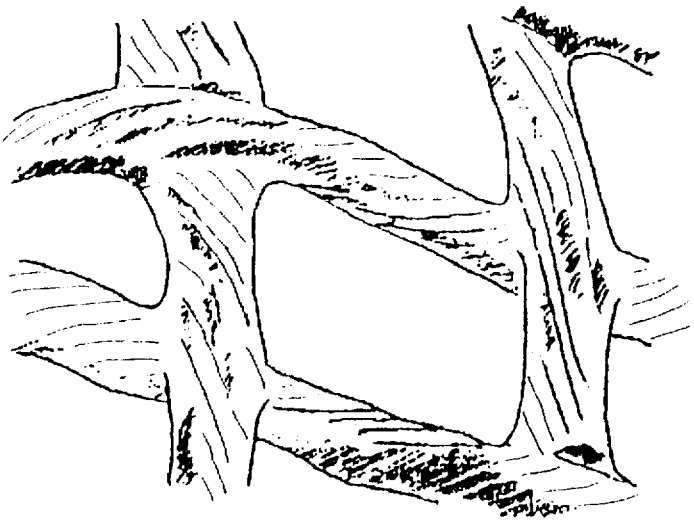

The matrix component of the speaker damper of the present invention is cloth formed of wholly aromatic polyamide yarn which is mixed yarn of a wholly aromatic polyamide fiber and an aromatic polyester fiber.

This mixed yarn may be filament yarn of a wholly aromatic polyamide fiber filament and an aromatic polyester fiber filament or spun yarn of a wholly aromatic polyamide short fiber and an aromatic polyester short fiber.

The wholly aromatic polyamide fiber forming the mixed yarn has extremely high heat resistance and a high modulus and is formed of an aromatic polyamide, as a polymer component, which consists of an aromatic diamine component and an aromatic dicarboxylic acid component. Since this wholly aromatic polyamide fiber has a softening point or a decomposition temperature of 350° C. or higher, more specifically 400° to 550° C., it exhibits extremely high heat resistance.

The wholly aromatic polyamide is preferably a polyamide which has metaphenylene isophthalamide units or paraphenylene terephthalamide units in a proportion of at least 50 mol % of the total of recurring units. Specific examples of the polyamide include polymetaphenylene isophthalamide, polyparaphenylene terephthalamide and copolymers thereof, whose examples include polyamides which comprise 3,4'-diaminodiphenyl ether and paraphenylene diamine as diamine components and terephthalic acid as a dicarboxylic acid component. Among them, polymetaphenylene isophthalamide is particularly preferred.

The fineness of the wholly aromatic polyamide fiber is 0.5 to 10 denier, preferably 1 to 5 denier. In the case of a short fiber, the fiber length is preferably in the range of 20 to 75 mm.

In the mixed yarn forming the cloth of the matrix component of the speaker damper of the present invention, the aromatic polyester fiber to be mixed with the wholly aromatic polyamide fiber is preferably formed of a polymer having a melting point or softening point by 100° C. or higher and particularly 150° to 200° C. lower than the softening point (or thermal decomposition temperature) of the polymer of the wholly aromatic polyamide fiber. Specifically, this aromatic polyester has preferably a melting point (softening point in the case of an amorphous polymer) of 120° to 270° C., more preferably 130° to 250° C., especially preferably 140° to 220° C.

Advantageously, the polyester forming the aromatic polyester fiber has ethylene terephthalate units in a proportion of at least 50 mol %, preferably at least 60 mol % of the total of recurring units. Illustrative examples of the polyester include polyethylene terephthalate or copolyesters which contain 50 mol % or more of ethylene terephthalate units. In the case of a copolyester, illustrative examples of its copolymer component include dicarboxylic acids such as isophthalic acid and naphthalenedicarboxylic acid; and glycols such as propylene glycol, 1,4-butane diol, diethylene glycol and 1,6-hexane diol. An example of the copolyester is a copolyester obtained from a dicarboxylic acid component which consists of terephthalic acid and isophthalic acid in a weight ratio of 60/40 and a glycol component which consists of ethylene glycol and diethylene glycol in a weight ratio of 88/12. The ratio of these components can be changed so that the softening point, measured by the DSC method, of the resulting copolyester should be about 110° C. and the melting point thereof should range from 130° to 180° C.

The aromatic polyester fiber having a fineness of 0.5 to 10 denier, preferably 1 to 5 denier, is used advantageously. When it is a short fiber, the fiber length thereof is preferably in the range of 20 to 75 mm.

The mixed yarn forming the cloth as a matrix component is composed of a wholly aromatic polyamide fiber and the aromatic polyester fiber. The mixing weight ratio of the wholly aromatic polyamide fiber to the aromatic polyester fiber is 50:50 to 85:15, preferably 55:45 to 80:20. If the proportion of the wholly aromatic polyamide fiber is below the above range, such inconvenience that the heat resistance of the cloth is impaired occurs. On the other hand, if the proportion of the aromatic polyester fiber is below the above range, the distortion of fabric interstices of the cloth may occur in the production process of a speaker damper.

The mixed yarn in which the wholly aromatic polyamide fiber and the aromatic polyester fiber are uniformly mixed in the above ratio forms the cloth as mixed yarn of 150 to 500 denier, preferably 200 to 400 denier.

The cloth which is the matrix component of the speaker damper of the present invention is formed of the above mixed yarn and may be a woven or knitted fabric. For example, it may be a plain, twill or satin woven fabric; or a warp knitted or weft knitted (flat knitted or circular knitted) fabric. Among these, woven cloth, especially plain woven cloth, is advantageous from the viewpoint of the characteristics of a damper and its processability.

The speaker damper of the present invention can be obtained by impregnating the above cloth as a substrate with an appropriate amount of a polyester resin and press-molding the impregnated substrate in a heated mold.

This polyester resin serves as a shape retaining agent in the speaker damper. Although when the cloth is pressure molded under heat without using the polyester resin, the cloth can be shaped as a sneaker damper, the thus obtained molded product can not have sufficient shape retaining property and hardness as a speaker damper and hence, cannot be put to practical use. On the other hand, when the cloth is impregnated with an appropriate amount of the polyester resin and molded under heat and pressure, the polyester resin is present between the fibers of the mixed yarn forming the cloth to fix the fibers together and is also present at the intersections of the mixed yarns to fix the yarns together firmly. The thus molded cloth serves as a speaker damper having sufficient hardness and shape retaining property.

Although the reason why the polyester resin has excellent properties as a shape retaining agent for the speaker damper of the present invention is not clear, it is presumed that it is probably due to affinity between the wholly aromatic polyamide fiber and the polyester resin and affinity between the aromatic polyester fiber and the polyester resin. Therefore, in the present invention, it is important to advantageously impregnate the cloth with the polyester resin prior to the molding of the cloth under heat and pressure.

An appropriate method for impregnating the cloth with the polyester resin is to use a solution of the polyester resin, preferably an aqueous solution of the polyester resin. The simplest method is to immerse the cloth in a polyester resin solution. As the polyester resin solution, that it is an aqueous solution is advantageous from the industrial standpoint and viewpoint of work environment. Therefore, a water-soluble polyester resin from which an aqueous solution of the polyester resin can be obtained is described in detail hereinafter.

As the water-soluble polyester resin, the one that is essentially composed of a dicarboxylic acid component and a diol component and further contains a copolymer component having a hydrophilic group to improve water solubility is used advantageously.

Illustrative examples of the dicarboxylic acid component forming the water-soluble polyester resin include aromatic dicarboxylic acids such as terephthalic acid, isophthalic acid and phthalic acid; aliphatic dicarboxylic acids such as adipic acid, succinic acid, sebacic acid and dodecane diacid; and the like. Illustrative examples of the diol component include ethylene glycol, propylene glycol, 1,4-butane diol, 1,6-hexane diol, neopentyl glycol, cyclohexane dimethanol, bisphenol and the like. To make the resin water-soluble, the resin is copolymerized with a copolymer component having a hydrophilic group. As a copolymer component having the hydrophilic group, a component having a sulfonic group or a derivative thereof in a side chain thereof, such as sodium 5-sulfoisophthalate, or polyethylene glycol is used.

The water solubility of the water-soluble polyester resin is desired to be such that 20 to 45 g, preferably 25 to 40 g, of the resin can be dissolved in 100 g of water at 30° C. When the cloth is immersed in an aqueous solution of the polyester resin, the concentration of the resin in the aqueous solution is 15 to 40% by weight, preferably 20 to 35% by weight.

Illustrative examples of the aromatic dicarboxylic acid component of the above water-soluble polyester resin include terephthalic acid, isophthalic acid, phthalic acid, naphthalenedicarboxylic acid, 4,4'-oxybenzoic acid and the like, of which terephthalic acid and isophthalic acid are preferred. The molar ratio of terephthalic acid to isophthalic acid is particularly preferably in the range of 65/35 to 50/50.

Illustrative examples of the diol component include an alkylene glycol having 2 to 6 carbon atoms such as ethylene glycol, propylene glycol, tetramethylene glycol and hexamethylene glycol, and diethylene glycol, of which ethylene glycol and diethylene glycol are preferred.

Illustrative examples of the dicarboxylic acid having a $SO_3M$ group (M is a metal ion) include metal salts of sulfonic acid such as sulfoterephthalic acid, 5-sulfoisophthalic acid, 4-sulfophthalic acid, 4-sulfonaphthalene-2,7-dicarboxylic acid and the like. Examples of the metal salt include alkali metal salts of sodium, potassium, lithium and the like. Among these, particularly preferred is 5-sodium sulfoisophthalic acid. The copolymerization ratio of the dicarboxylic acid having a $SO_3M$ group is 40 mol % or less, particularly preferably 5 to 20 mol %, based on the total dicarboxylic acid component of the copolyester. When the copolymerization ratio is more than 40 mol %, the melt viscosity of the copolyester drastically increases, thereby making it difficult to obtain a polymer having a desired degree of polymerization with a melt polymerization method, which is disadvantageous.

Further, illustrative examples of the polyoxyalkylene glycol include polyoxyethylene glycol, polyoxypropylene glycol, a copolymer of polyoxyethylene glycol and polyoxypropylene glycol and the like, of which polyoxyethylene glycol is preferred. One hydroxyl group of the polyoxyalkylene glycol may be terminated with an ether bond. For example, monomethyl ether, monoethyl ether, monophenyl ether or the like may be used as such terminator. The average molecular weight of the polyoxyalkylene glycol is usually 500 to 12,000, particularly preferably 1,000 to 6,000. The amount of the polyoxyalkylene glycol copolymerized is 20 to 90% by weight, preferably 30 to 80% by weight, based on the weight of the resulting copolyester.

The water-soluble polyester composed of the above aromatic dicarboxylic acid, diol and dicarboxylic acid having a $SO_3M$ group (M is a metal ion) and/or polyoxyalkylene glycol may contain a slight amount of a copolymer component other than the above within limits not prejudicial to the object of the present invention.

The intrinsic viscosity (measured at 25° C. in O-chlorophenol) of the water-soluble polyester is preferably in the range of 0.2 to 0.55. The term "water solubility" as used herein is applied not only to what is perfectly soluble in water but also to what can be finely dispersed in water.

When the polyester resin is molded under heat and pressure after it is impregnated into the cloth, a polyester resin that is cured by crosslinking is advantageous, and various types of crosslinking agent can be used. Illustrative examples of the crosslinking agent include melamine, methylol melamine, triisocyanate and the like. Use of the crosslinking agent can impart appropriate hardness to a molded product. Among these crosslinking agents, melamine and methylol melamine are preferred because they can impart preferable physical properties to a molded product and do not contaminate the mold during molding. The amount of the crosslinking agent to be added, which differs according to kind thereof, is suitably 20 to 30% by weight of the polyester resin (solid content).

The proportion of the polyester resin to be adhered to the cloth by impregnation exerts influence on the performance and physical properties of the speaker damper. The proportion of the polyester resin to be adhered to the cloth is 15 to 40% by weight, preferably 20 to 35% by weight of the cloth, in terms of dry weight. When the proportion of the polyester resin (shape retaining agent) is below the above range, the hardness of the resulting molded product is insufficient and physical properties thereof greatly deteriorate when it is used as a speaker damper for a prolonged period. On the other hand, when the proportion is beyond the above range, the heat resistance of the molded product decreases with the result of deterioration in the characteristics of a speaker damper.

To set the amount of the resin adhered to the above range after the cloth is impregnated with the polyester resin solution, the concentration of the solution and the squeeze of the cloth with a mangle after impregnation may be suitably selected or controlled. Then, after drying, the cloth adhered by the resin is molded.

A mold capable of giving the shape of a speaker damper is used as the mold, and temperature and pressure thereof are selected so as to provide sufficient hardness and the shape of a speaker damper to the cloth adhered by the polyester resin.

A speaker damper can be obtained through the following process. Due to heat and pressure in the mold, the wholly aromatic polyamide fibers constituting the mixed yarn are fixed together by the fusion of the aromatic polyester fibers, the constituent fibers forming the yarn are fixed together with the shape retaining agent containing the polyester resin in the mixed yarn, and further the mixed yarns of the cloth are fixed together at the intersections thereof by the fusion of the aromatic polyester fibers and the shape retaining agent containing the polyester resin. Thus, the speaker damper of the invention can be obtained.

Although the temperature of the mold is affected by the fusing temperature of the aromatic polyester fiber, the fixing temperature of the polyester resin, the structure of the cloth and the like, it is generally 130° to 250° C., preferably 140° to 230° C. The molding time is 30 seconds to 10 minutes, preferably 1 to 5 minutes.

Since the speaker damper of the present invention is used for the purpose of stably holding a coil bobbin in a speaker and needs to have a function to vibrate a speaker corn precisely, it must be lightweight, thin and have an appropriate gas permeability. The speaker damper has a cloth thickness of 0.1 to 0.7 mm, preferably 0.2 to 0.5 mm, and is generally shaped like a circular disk with concentric corrugations.

The speaker damper of the present invention has a gas permeability, measured in accordance with JIS L-1096, of 70 to 170 $cm^3/cm^2 \cdot sec$, preferably 100 to 140 $cm^3/cm^2 \cdot sec$.

The speaker damper of the present invention uses the above cloth and polyester resin, and has desired hardness by fusion and fixing between the mixed yarns and in the mixed yarn, as well as excellent water resistance and moisture resistance. Particularly, for water resistance, the speaker damper of the present invention has a change rate (%) in the flexibility after it is immersed in water at normal temperature (20° C.) for 24 hours of 5% or less, more specifically 3% or less.

The speaker damper of the present invention is free from a remarkable reduction in rigidity as a damper even when it is subjected to repetitions of deformation such as deflection and bending because the aromatic polyester fiber contained in the cloth has appropriate flexibility and the polyester resin used as a shape retaining agent has affinity for the aromatic polyester fiber and the wholly aromatic polyamide fiber. A speaker using this damper does not experience great reduction in performance after long-time continuous operation. Since the polymers as materials of the fibers constituting the cloth have an extremely small coefficient of water absorption, the speaker damper which is a molded product of the cloth formed of the above fibers is free from deformation caused by the stretch of the fiber caused by water absorption and hence, does not affect the performance of a speaker. In addition, the present invention makes it possible to produce a speaker damper which is excellent in moldability, water resistance and durability by a simpler process than the prior art without worsening work environment.

EXAMPLES

The following examples are given to further illustrate the present invention.

Examples 1 to 5, Comparative Examples 1 to 4

Polymetaphenylene isophthalamide short fibers (Cornex manufactured by Teijin Ltd., Type HG, single yarn fineness: 2 denier) and low-melting polyester short fibers (manufactured by Teijin Ltd., softening point: 110° C., single yarn fineness: 2 denier) were used and mixed together in a weight ratio of 70/30 to produce spun yarn of 250 denier. The thus obtained spun yarn was used to obtain cloth (plain weave) at both weft and warp densities of 38 yarns/inch. Separately, an aqueous solution was prepared by mixing 200 g of a water-soluble polyester resin (manufactured by Gooh Kagaku Co. Ltd, trade name: Plus Coat, Z-561, concentration: 25%) with 15 g of melamine (for example, manufactured by Sumitomo Chemical Co. Ltd, trimethylol melamine, trade name: M-3, concentration of 80%) and 15 g of a reaction promoting agent (manufactured by Sumitomo Chemical Co. Ltd, hydrochloric acid salt of alkanolamine, trade name: Sumitex ACX, concentration: 30%), adding water to the mixture, the amount of water added being changed according to the target amount of impregnation, and mixing them under stirring. The above prepared cloth was immersed in this aqueous solution, squeezed uniformly with a mangle and dried in a drier heated at 120° C. for 3 minutes.

Thereafter, the cloth adhered by the polyester resin was cut into a predetermined sized piece and was placed in a mold and heat-molded by a press heated at 180° C. for 2 minutes. A flat portion of the thus obtained molded product was cut to a width of 5 mm. One end of the 20 mm long rectangular molded product was supported and a plumb was hung from the other end thereof to determine the hardness of the sample in terms of the weight of the plumb required for the deflection of the cloth. In Comparative Examples 2 and 3, a phenol resin was impregnated. In Table 1, moldability is evaluated by observing the molded edges of uneven portions of the mold with naked eyes. When the edges are molded sharp, they are evaluated as "good", when the edges are molded rather round, they are evaluated as "poor", and when the edges are molded in an intermediate of the above evaluations, they are evaluated as "fair".

TABLE 1

| | mixing ratio of whole aromatic polyamide fiber to aromatic polyester fiber | amount of resin impregnated % | hardness | moldability |
|---|---|---|---|---|
| Comp. Ex. 1 | 100/0 | 24 | 1.5 | poor |
| Comp. Ex. 2 | 50/50 | — | 2 | good |
| Comp. Ex. 3 | 80/20 | — | 1.8 | good |
| Example 1 | 45/55 | 25 | 1.6 | fair |
| Example 2 | 50/50 | 24 | 2.2 | good |
| Example 3 | 75/25 | 25 | 2 | good |
| Example 4 | 80/20 | 24.5 | 2 | good |
| Example 5 | 85/15 | 24 | 1.5 | fair |
| Comp. Ex. 4 | 0/100 | 25.5 | 0.8 | poor |

Comp. Ex.: comparative Example

For evaluations on the characteristics of the damper, the substrate was pressed in a mold heated at a temperature of 180° C. under a pressure of 2 $kg/cm^2$ for 10 seconds, and the mold was opened to take out the molded product. The outer periphery of the molded product was cut out to prepare a doughnut-shaped damper having an outer diameter of 6 mm and a neck diameter of 19 mm. Speaker dampers obtained in Examples 1 to 5 had almost the same outer appearance and flexibility. An enlarged view of the surface of the speaker damper of each of the examples before molding is shown in FIG. 1(*a*) and an enlarged view of the surface of the speaker damper after molding is shown in FIG. 1(*b*). As is evident from FIG. 1(*a*) and FIG. 1(*b*), fibers forming the cloth were fused by heat at the time of molding and solidified, fused the intersections of yarns and covered the surfaces of yarns. When observed through a microscope, the molded products of the above examples had the same shape.

The dimensional accuracies and water resistances of the molded products as speaker dampers according to the examples of the present invention are shown in Table 2. The dimensional accuracy of a molded product is represented by the flatness of the outer periphery of a olded speaker damper. The measurement of surface flatness was carried out by placing a damper on a flat and smooth plate and measuring the warp of the outer periphery of the bottom surface of the damper with a height gauge. Water resistance was obtained by measuring values before and after immersion in city water for 24 hours as a change in flexibility in a wet condition. Flexibility is represented in mm by the size of deflection produced when a lightweight disk is placed on a central neck portion of the damper and a weight of 50 g was placed on the disk. Dimensional stability was evaluated by the above warp after the above operation.

For comparison, cloth prepared by impregnating plain cotton cloth which was obtained by weaving cotton yarn of No.20 at densities of 38 wefts/inch and 38 warps/inch with 15% by weight of a phenol resin was used as a substrate and pressure molded in a mold heated at a temperature of 220° C. under a pressure of 2 kg/cm$^2$ for 5 seconds to obtain a molded product as the prior art. The results of the same evalution for the thus obtained molded product are also shown in Table 2.

TABLE 2

| | dimensional | water resistance | |
|---|---|---|---|
| | accuracy (mm) | flexibility change rate (%) | dimensional stability (mm) |
| Example 2 | 0.15 | 2.43 | 0.18 |
| Example 3 | 0.13 | 2.3 | 0.15 |
| Example 4 | 0.11 | 1.98 | 0.1 |
| Comparative Example (prior art) | 0.85 | 56.2 | 1.02 |

It is understood that the dampers of the above examples experience a small warp of the molded products and have excellent dimensional accuracy. It is also understood that they are lower in flexibility and dimensional stability in a wet condition than the prior art and excellent in water resistance.

Figure 2:
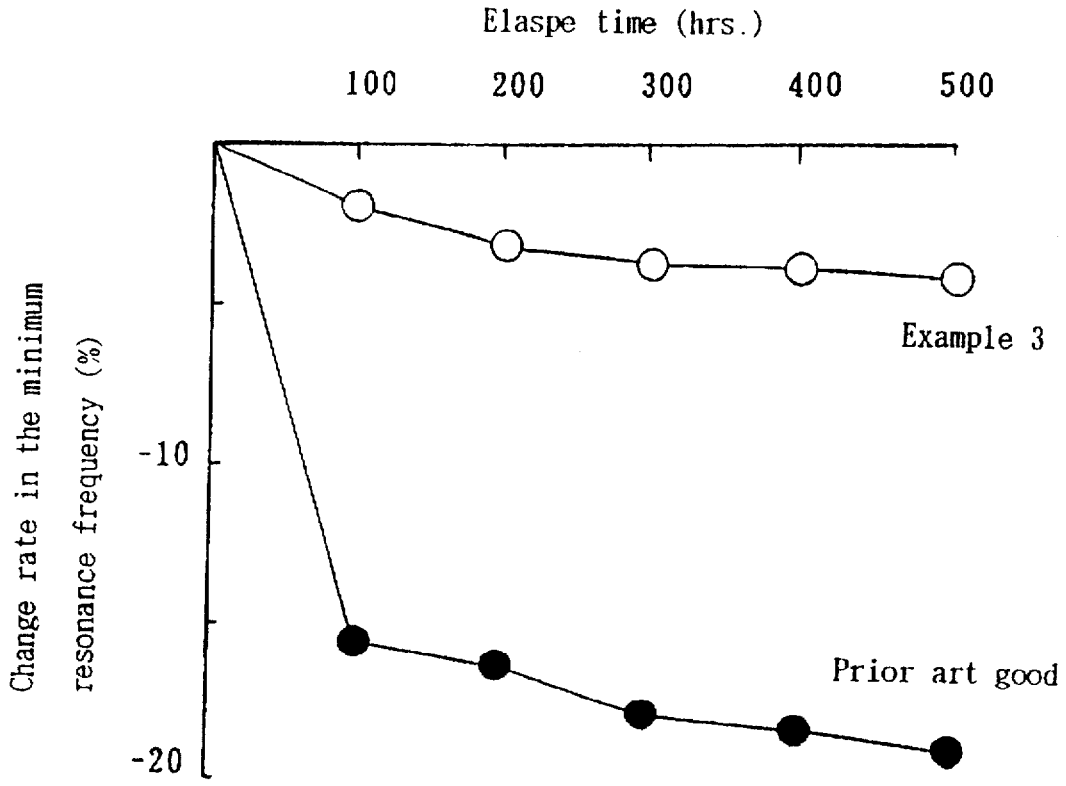
FIG. 2 is a characteristic diagram showing the comparison of changes in the minimum resonance frequency between the prior art and the present invention in the continuous operation test of speakers which use speaker dampers obtained in Example 3.

As for durability, changes in the minimum resonance frequency in the continuous operation of 16 cm diameter speakers using dampers molded of the same substrate with the passage of time are shown in FIG. 2. It is revealed that, compared with a speaker damper of the prior art which uses cotton cloth as a substrate, the change rate of the minimum resonance frequency in the continuous operation of a speaker using the damper of the present invention is extremely small.

FIG. 2 shows data on Example 3 together with data on the prior art. When the speaker dampers of Examples 1, 2, 4 and 5 were measured for the change rate of the minimum resonance frequency, their rates were found to be −4 to −7% after an elapse of 500 hours.

What is claimed is:

1. A speaker damper which is composed of cloth, as a matrix component, formed of a mixed yarn comprising wholly aromatic polyamide fibers and thermoplastic aromatic polyester fibers wherein (i) said thermoplastic aromatic polyester fiber having a thermal fusing temperature which is at least 100° C. lower than a thermal decomposition temperature of said wholly aromatic polyamide fiber constituting said mixed yarn, (ii) said wholly aromatic polyamide fibers constituting said mixed yarn are fixed together by the fusion of said thermoplastic aromatic polyester fiber, (iii) said fibers forming said yarn are fixed together with a shape retaining agent comprising a polyester resin which has been impregnated in said mixed yarn, and (iv) said mixed yarn, at intersections thereof in said cloth, being fixed together by the shape retaining agent comprising a polyester resin which has been impregnated in said mixed yarn and by the fusion of said thermoplastic aromatic polyester fiber;

said polyester resin which has been impregnated in said mixed yarn being present in an amount of 15 to 40% by weight of said cloth;

said speaker damper having a gas permeability of 70 to 170 cc/cm$^2$·sec.

2. The speaker damper according to claim 1, wherein said mixed yarn comprises said wholly aromatic polyamide fiber and said aromatic polyester fiber in a weight ratio of 50:50 to 85:15.

3. The speaker damper according to claim 1, wherein said wholly aromatic polyamide fiber is formed of a polymer having metaphenylene isophthalamide units or paraphenylene terephthalamide units in a proportion of at least 50 mol % of the total of recurring units.

4. The speaker damper according to claim 1, wherein said aromatic polyester fiber is formed of a polymer having ethylene terephthalate units in a proportion of at least 50 mol % of the total of recurring units.

5. The speaker damper according to claim 1, wherein the polyester resin as said shape retaining agent is a thermoset polyester resin.

6. The speaker damper according to claim 1 which is shaped by molding under heat and pressure.

7. The speaker damper according to claim 1 which has such water resistance that a change rate in flexibility after 24 hours of immersion in water is 5% or less.

* * * * *